US006398969B1

(12) United States Patent
Hartmann

(10) Patent No.: US 6,398,969 B1
(45) Date of Patent: Jun. 4, 2002

(54) HYDROCYCLONE AND PROCESS FOR REMOVING FOREIGN SUBSTANCES FROM A LIQUID

(75) Inventor: Rolf Hartmann, Weingarten (DE)

(73) Assignee: Voith Sulzer Papiertechnik Patent GmbH, Ravensburg (DE)

( * ) Notice: Subject to any disclaimer, the term of this patent is extended or adjusted under 35 U.S.C. 154(b) by 29 days.

(21) Appl. No.: 09/605,534

(22) Filed: Jun. 29, 2000

(30) Foreign Application Priority Data

Jun. 30, 1999 (DE) ..... 199 30 088

(51) Int. Cl.[7] ..... B01D 21/26

(52) U.S. Cl. ..... 210/742; 116/216; 162/55; 209/725; 209/726; 209/728; 209/732; 209/733; 210/788; 210/85; 210/149; 210/512.1; 210/512.2

(58) Field of Search ..... 116/216; 215/11.2; 210/742, 788, 85, 149, 512.1, 512.2; 209/725, 726, 728, 732, 733; 162/55

(56) References Cited

U.S. PATENT DOCUMENTS 4,878,588 A * 11/1989 Ephriam ..... 215/11.2

FOREIGN PATENT DOCUMENTS

CH 681360 3/1993

GB 2268691 A1 * 1/1994

OTHER PUBLICATIONS

PTO—2001–4457–Translation of Switzerland Reference CH 681360 A5.*

* cited by examiner

*Primary Examiner*—David A. Reifsnyder
(74) *Attorney, Agent, or Firm*—Greenblum & Bernstein, P.L.C.

(57) ABSTRACT

Hydrocyclone and process for removing foreign substances from a liquid to be cleaned. The hydrocyclone includes at least one inlet for the liquid to be cleaned, at least one accepted stock outlet for the cleaned liquid, and at least one reject opening for foreign substances removed from the liquid to be cleaned. The at least one reject opening includes at least one stoppage-hazard zone, and a color layer is coupled to an exterior wall of the hydrocyclone. The color layer changes appearance in accordance with different temperatures. The process includes introducing the liquid to be cleaned into a hydrocyclone through at least one inlet, discharging cleaned liquid from the hydrocyclone through at least one accepted stock outlet, and discharging the foreign substances from the hydrocyclone through at least one reject opening. The process also includes detecting one of a potential and an actual stoppage in a stoppage-hazard zone of the at least one reject opening by monitoring a color change of a color layer coupled to an exterior wall of the hydrocyclone.

26 Claims, 2 Drawing Sheets

Fig. 1
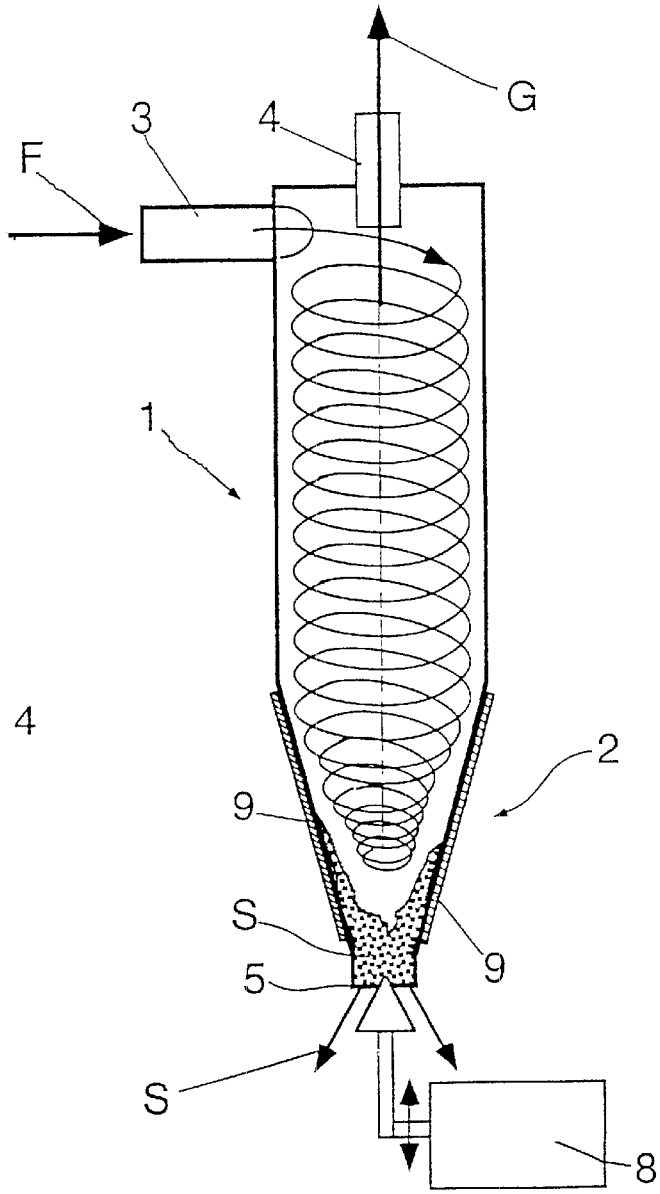
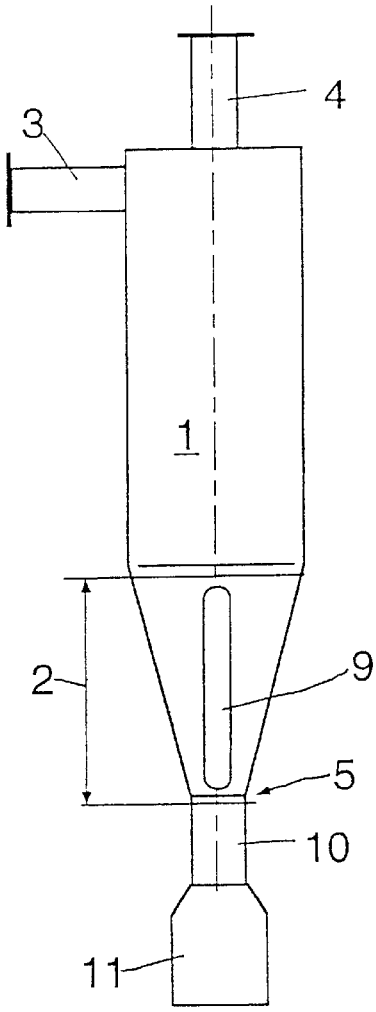
Fig. 2

Fig. 3
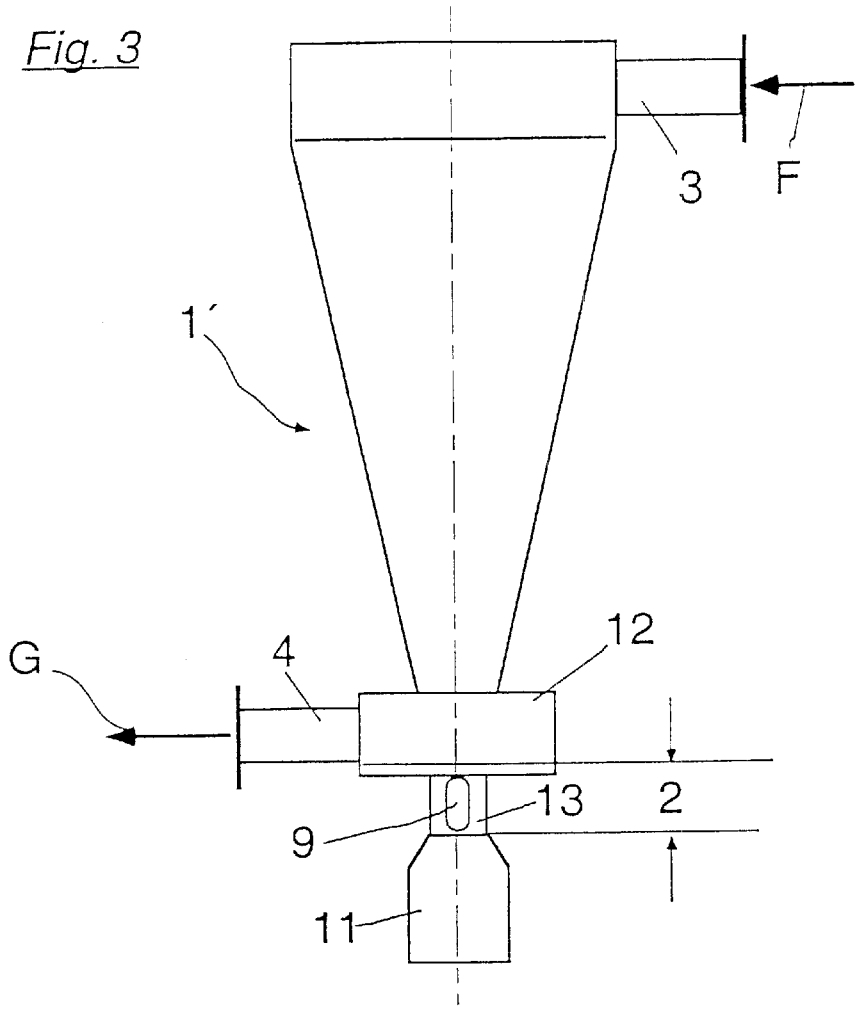
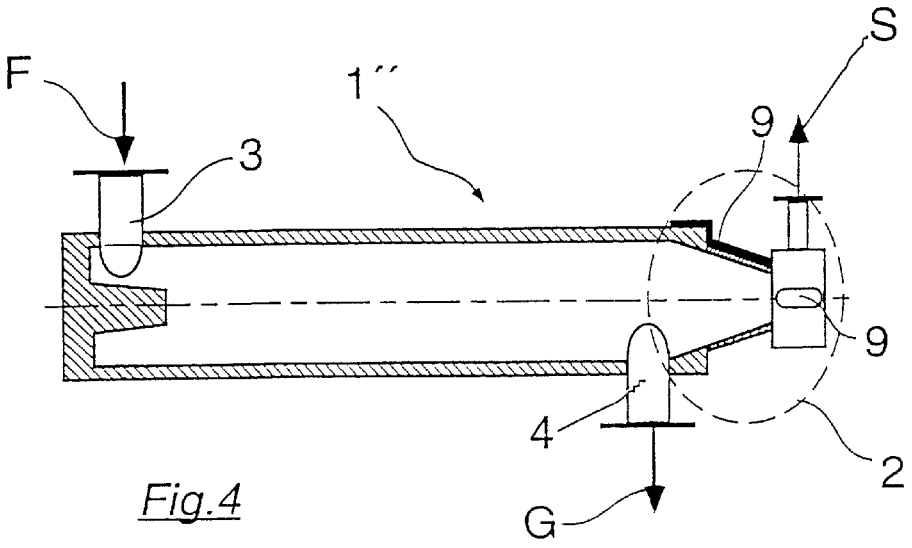
Fig.4

HYDROCYCLONE AND PROCESS FOR REMOVING FOREIGN SUBSTANCES FROM A LIQUID

CROSS-REFERENCE TO RELATED APPLICATIONS

The present application claims priority under 35 U.S.C. §119 of German Patent Application No. 199 30 088.7, filed on Jun. 30, 1999, the disclosure of which is expressly incorporated by reference herein in its entirety.

BACKGROUND OF THE INVENTION

1. Field of the Invention

The present invention relates to a hydrocyclone for removing foreign substances from a liquid which includes at least one inlet for the liquid to be cleaned, at least one accepted stock outlet for the cleaned liquid, and at least one reject opening for foreign substances, which has at least one stoppage-hazard zone.

2. Discussion of Background Information

As is generally known, hydrocyclones are used for concentrating and draining off liquids containing foreign substances using strong centrifugal forces. They are frequently used in the removal of small metal parts, glass splinters, and sand from fibrous stock suspensions. As a result of the accumulation of foreign substances in specific areas of the hydrocyclone, stoppages are to be expected if all operating parameters are not set optimally. However, due to frequently changing operating conditions, such as the dirt load, the occurrence of stoppages cannot always be prevented. For this reason, a hydrocyclone must, as a rule, be expected to have a stoppage-hazard zone. The formation of stoppages has at least two considerable disadvantages: The hydrocyclone will then no longer fulfill its task, i.e., will no longer be able to remove foreign substances; and in some cases, high local wear occurs on the hydrocyclone that is caused by the heavy parts rotating at one location and thus abrading the wall of the hydrocyclone.

Continuous monitoring of the hydrocyclone is required in order to avoid the occurrence of stoppages or at least to shorten this undesired state. However, because many facilities contain a large number of hydrocyclones, this can be expensive.

A process for monitoring a cyclone is disclosed, e.g., in CH 681360 A, which discloses that the surface temperature on the cyclone is determined and compared to that of the ambient temperature. In the case of stoppages, these two temperatures approach each other. An evaluation circuit is informed of the stoppage via a data line so that it can emit a warning and/or adjustment signal. This process is to be operated only with a plurality of measuring transducers and corresponding regulating and adjustment effort.

SUMMARY OF THE INVENTION

The present invention provides a hydrocyclone in which it is possible to discover and eliminate stoppages in the short term using the simplest manner.

Further, the present invention includes a color layer which is attached on the exterior wall of the hydrocyclone whose appearance changes with different temperatures.

In the case of hydrocyclones equipped according to the invention, a layer is provided at critical locations that changes its appearance, e.g., its color, in accordance with temperature changes in the area of interest. In this manner, the present invention utilizes the fact that critical accumulation of substances that may cause stoppages, e.g., foreign substances, produces or creates temperature changes. The reason is that the temperature of the liquid to be cleaned almost always deviates from the ambient temperature. For example, the temperature is higher at locations at which the liquid is flowing by the wall of the flow device, thereby producing heat. As a consequence, an approximately uniform temperature adjusts or occurs during the undisturbed operation of the flow device. However, if the accumulation of foreign substances becomes so great that the flow is partially brought to a standstill, i.e., a stoppage is imminent, the flow device begins to cool at this location toward the ambient temperature. As a result, a local temperature change can be viewed as an indicator of a stoppage, e.g., that has begun or that has already occurred. In this way, it is possible to prevent or quickly eliminate operating malfunctions. Tests determine the to-be-prescribed extent of the temperature deviation at which a critical accumulation of foreign substances is present. It depends, among other things, on the level and constancy of the temperature of the liquid in the flow device.

In this manner, it is very easy to monitor an entire battery of hydrocyclones. No lines are required for the power supply or measuring data and measuring strips that change color as a function of temperature are inexpensive and easy to handle. Such measuring strip are used as thermometers, which, though easy to read, are often slow-reacting and imprecise. However, they are ideal for the instant invention to provide "at a glance" detection. This is particularly advantageous with the conventionally large number of hydrocyclones in a facility. Moreover, it is not necessary to determine or detect an exact numerical value of the temperature.

While somewhat more expensive, an optical remote display of the changes, e.g., in a control room, can be provided with a monitoring camera.

The present invention is directed to a hydrocyclone for removing foreign substances from a liquid to be cleaned. The hydrocyclone includes at least one inlet for the liquid to be cleaned, at least one accepted stock outlet for the cleaned liquid, and at least one reject opening for foreign substances removed from the liquid to be cleaned. The at least one reject opening includes at least one stoppage-hazard zone, and a color layer is coupled to an exterior wall of the hydrocyclone. The color layer changes appearance in accordance with different temperatures.

In accordance with a feature of the instant invention, the at least one reject opening can be arranged for discharging heavy parts. Alternatively, the at least one reject opening can be arranged for discharging light parts.

According to another feature of the invention, the color layer can change its color as it is cooled.

In accordance with still another feature of the present invention, the color layer can change its color as a warning.

According to a further feature of the invention, the color layer can be coupled in a vicinity of the at least one reject opening. Moreover, the color layer can be coupled to a connection line downstream of the at least one reject opening.

Moreover, the color layer can be adapted to change its appearance to indicate a temperature change of between about 25 and 40° C.

The color layer can include a foil. Further, the foil can be glued onto the exterior wall.

The hydrocyclone can be adapted for separating foreign substances from a papermaking fiber suspension whose temperature deviates from the ambient temperature.

Further, an adjusting device may be coupled to the at least one reject opening. A flow cross-section of the at least one reject opening can be enlarged by the adjusting device.

Still further, the color layer can be arranged to change color as a temperature at the exterior wall decreases. The color layer can be adapted to change color in response to a temperature change of between about 25 and 40° C.

The present invention is directed to a hydrocyclone facility that includes at least ten simultaneously operated hydrocyclones. The hydrocyclones include a color layer coupled to exterior walls of the hydrocyclones, such that the color layer changes its appearance in accordance with a changing temperature difference between the exterior wall and an ambient temperature.

The present invention is directed to a process for removing foreign substances from a liquid to be cleaned. The process includes introducing the liquid to be cleaned into a hydrocyclone through at least one inlet, discharging cleaned liquid from the hydrocyclone through at least one accepted stock outlet, and discharging the foreign substances from the hydrocyclone through at least one reject opening. The process also includes detecting one of a potential and an actual stoppage in a stoppage-hazard zone of the at least one reject opening by monitoring a color change of a color layer coupled to an exterior wall of the hydrocyclone.

According to a feature of the invention, the color layer can be adapted to change color in accordance with a changing temperature difference between the exterior wall of the hydrocyclone and an ambient temperature.

In accordance with another feature of the present invention, the color layer can be adapted to change color when an accumulation of foreign substances substantially prevents the flow of the liquid to be cleaned in the stoppage-hazard zone.

Moreover, the color layer can be coupled to a conical portion of the hydrocyclone which forms at least a portion of the at least one reject opening.

Further, the stoppage-hazard zone may be a light substance pipe coupled to a deposition pot.

The process can also include discharging heavy parts through the at least one rejects opening. In this manner, the color layer may be coupled to a conical portion of the at least one reject opening. In an alternative arrangement, the process can include discharging light parts through the at least one rejects opening. In this way, the color layer may be coupled to a conical portion of the at least one reject opening. Moreover, the color layer may be coupled to a light substance pipe, which is coupled to a deposition pot.

According to yet another feature of the instant invention, the process can further include enlarging a cross-section of the at least one reject opening in accordance with the appearance of the color layer.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 illustrates a section of a hydrocyclone according to the invention for the deposition of heavy parts;

FIG. 2 illustrates a side view of a hydrocyclone similar to the one depicted in FIG. 1;

FIGS. 3 and 4 each illustrate a hydrocyclone according to the invention for the deposition of light parts.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 illustrates a hydrocyclone 1 intended to remove heavy parts with an inlet 3 for the liquid F to be cleaned. As is known, liquid F is set into rotation in hydrocyclone 1, whereby centrifugal forces occur which lead to the foreign substances being centrifuged onto the inside wall of hydrocyclone 1. Accepted stock G cleaned in this way is released through an accepted stock outlet 4, in this case, in an upper part of hydrocyclone 1. A concentration of the foreign substances S occurs in a stoppage-hazard zone 2, which is a desired result, i.e., foreign substances S are supposed to accumulate and flow off from hydrocyclone 1 through reject opening 5. However, the exemplary embodiment depicts that a stoppage has already occurred, i.e., foreign substances S are so strongly concentrated in the lower part of hydrocyclone 1 that their outflow has been interrupted. As a result of this situation, liquid F can no longer flow directly past the wall in stoppage-hazard zone 2, which causes a temperature change to occur there, e.g., the temperature in this area begins to change toward the ambient temperature. This change in temperature can be visibly detected by a color layer 9 attached to outside of the wall in stoppage-hazard zone 2, which changes its appearance, e.g., it at least partially turns another color, as the temperature in stoppage-hazard zone 2 begins to change. An adjusting device 8 can be actuated so as to increase the cross-section in the area of reject opening 5. This measure is performed until the stoppage is eliminated. While not shown in the figure, other measures for removing the accumulations are shaking or the local addition of water.

FIG. 2 illustrates a hydrocyclone according to the invention in schematic form, in this case, with a connection line 10 to a deposition pot 11 for the foreign substances. A color layer 9, whose color changes depending upon or in accordance with the temperature, is attached in a conical area. This measure can also be performed as a retrofitting action on an already installed hydrocyclone.

Hydrocyclone 1' shown in FIG. 3 is designed so that an accepted stock G is formed from added liquid F, from which the light parts contained therein are removed to the greatest possible degree. For this purpose, an accepted stock annular space 12 is situated at a lower part of a deposition cone, from which accepted stock G can be removed tangentially or radially to the outside via accepted stock outlet 4. The light parts, which naturally accumulate in the center of hydrocyclone 1', can be drained off into deposition pot 11 via light substance pipe 13. Stoppage-hazard zone 2 is normally located in the area of light part pipe 13. Accordingly, as shown here, this zone is provided with a color layer 9.

As is well known, hydrocyclones can also be utilized in a lying form as shown in FIG. 4. Hydrocyclone 1" can be arranged for removing light parts. Accepted stock G can be directly carried off tangentially from hydrocyclone 1" while the light parts are directed out concentrically via a conical part. Stoppage-hazard zone 2 normally includes all these areas that are used to drain off the light parts. Further, color layers 9 can be attached at several locations.

Moreover, the above-noted features of the invention can also be applied to flow devices other than the ones depicted in the illustrated embodiments in which deposits form at certain locations and in which, during operation, the temperature of the liquids deviate from the ambient temperature. Besides the hydrocyclones, heavy part gates or heavy part sluices in paper pulp processing facilities could be conceivable or critical locations in pipelines through which highly-loaded mixtures flow.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A hydrocyclone for removing foreign substances from a liquid to be cleaned comprising:

at least one inlet for the liquid to be cleaned;

at least one accepted stock outlet for the cleaned liquid;

at least one reject opening for foreign substances removed from the liquid to be cleaned;

said at least one reject opening comprising at least one stoppage-hazard zone; and a color layer coupled to an exterior wall of said hydrocyclone, wherein said color layer changes appearance in accordance with different temperatures.

2. The hydrocyclone in accordance with claim 1, wherein said at least one reject opening is arranged for discharging heavy parts.

3. The hydrocyclone in accordance with claim 1, wherein said at least one reject opening is arranged for the discharging light parts.

4. The hydrocyclone in accordance with claim 1, wherein said color layer changes its color as it is cooled.

5. The hydrocyclone in accordance with claim 1, wherein said color layer changes its color as a warning.

6. The hydrocyclone in accordance with claim 1, wherein said color layer is coupled in a vicinity of said at least one reject opening.

7. The hydrocyclone in accordance with claim 1, wherein said color layer is coupled to a connection line downstream of said at least one reject opening.

8. The hydrocyclone in accordance with claim 1, wherein said color layer is adapted to change its appearance to indicate a temperature change of between about 25 and 40° C.

9. The hydrocyclone in accordance with claim 8, wherein said foil is glued onto said exterior wall.

10. The hydrocyclone in accordance with claim 1, wherein said color layer comprises a foil.

11. The hydrocyclone in accordance with claim 1, wherein said hydrocyclone is adapted for separating foreign substances from a papermaking fiber suspension whose temperature deviates from the ambient temperature.

12. The hydrocyclone in accordance with claim 1, further comprising an adjusting device coupled to said at least one reject opening, wherein a flow cross-section of said at least one reject opening can be enlarged by said adjusting device.

13. The hydrocyclone in accordance with claim 1, wherein said color layer is arranged to change color as a temperature at said exterior wall decreases.

14. The hydrocyclone in accordance with claim 13, wherein said color layer is adapted to change color in response to a temperature change of between about 25 and 40° C.

15. A hydrocyclone facility comprising:

at least ten simultaneously operated hydrocyclones, wherein said hydrocyclones comprise a color layer coupled to exterior walls of said hydrocyclones, such that said color layer changes its appearance in accordance with a changing temperature difference between said exterior wall and an ambient temperature.

16. A process for removing foreign substances from a liquid to be cleaned, the process comprising:

introducing the liquid to be cleaned into a hydrocyclone through at least one inlet;

discharging cleaned liquid from the hydrocyclone through at least one accepted stock outlet;

discharging the foreign substances from the hydrocyclone through at least one reject opening;

detecting one of a potential and an actual stoppage in a stoppage-hazard zone of the at least one reject opening by monitoring a color change of a color layer coupled to an exterior wall of the hydrocyclone.

17. The process in accordance with claim 16, wherein said color layer is adapted to change color in accordance with a changing temperature difference between the exterior wall of the hydrocyclone and an ambient temperature.

18. The process in accordance with claim 16, wherein said color layer is adapted to change color when an accumulation of foreign substances substantially prevents the flow of the liquid to be cleaned in the stoppage-hazard zone.

19. The process in accordance with claim 16, wherein said color layer is coupled to a conical portion of the hydrocyclone which forms at least a portion of the at least one reject opening.

20. The process in accordance with claim 16, wherein the stoppage-hazard zone is a light substance pipe coupled to a deposition pot.

21. The process in accordance with claim 16, further comprising discharging heavy parts through the at least one reject opening.

22. The process in accordance with claim 21, wherein the color layer is coupled to a conical portion of said at least one reject opening.

23. The process in accordance with claim 16, further comprising discharging light parts through the at least one reject opening.

24. The process in accordance with claim 23, wherein the color layer is coupled to a conical portion of said at least one reject opening.

25. The process in accordance with claim 23, wherein the color layer is coupled to a light substance pipe, which is coupled to a deposition pot.

26. The process in accordance with claim 16, further comprising:

enlarging a cross-section of said at least one reject opening in accordance with the appearance of the color layer.

* * * * *